US009851115B2

(12) United States Patent
McIver

(10) Patent No.: US 9,851,115 B2
(45) **Date of Patent: *Dec. 26, 2017**

(54) VENT SEALING DEVICE AND SYSTEM

(71) Applicant: Andrew McIver, Altamonte Springs, FL (US)

(72) Inventor: Andrew McIver, Altamonte Springs, FL (US)

(73) Assignee: Cicada Holding, LLC, Altamonte Springs, FL (US)

( * ) Notice: Subject to any disclaimer, the term of this patent is extended or adjusted under 35 U.S.C. 154(b) by 666 days.

This patent is subject to a terminal disclaimer.

(21) Appl. No.: 14/468,668

(22) Filed: Aug. 26, 2014

(65) Prior Publication Data

US 2014/0364050 A1 Dec. 11, 2014

Related U.S. Application Data

(63) Continuation-in-part of application No. 13/098,702, filed on May 2, 2011, now Pat. No. 8,845,406.

(60) Provisional application No. 61/332,550, filed on May 7, 2010.

(51) Int. Cl.
*F24F 13/20* (2006.01)
*F24F 7/02* (2006.01)

(52) U.S. Cl.
CPC ..... *F24F 7/02* (2013.01); *F24F 2221/16* (2013.01); *F24F 2221/52* (2013.01)

(58) Field of Classification Search
CPC ..... F24F 7/02; E04D 13/1476; E04D 13/14
See application file for complete search history.

(56) References Cited

U.S. PATENT DOCUMENTS 558,025 A 4/1896 Barry
1,317,574 A 9/1919 Grosvold
2,821,900 A * 2/1958 Primich ..... E04D 13/1475 138/158
3,977,137 A 8/1976 Patty
4,115,961 A * 9/1978 Bishop ..... E04D 13/14 285/42
5,245,804 A * 9/1993 Schiedegger ..... E04D 13/1476 285/43
5,390,451 A * 2/1995 Kopp ..... E04D 13/1471 285/43
5,431,815 A * 7/1995 Te-Shin ..... E03C 1/122 137/625.32
5,694,724 A * 12/1997 Santiago ..... E04D 13/1476 285/44
5,724,777 A * 3/1998 Hubbard ..... E04D 13/0409 210/163
5,778,611 A * 7/1998 Michel ..... E04D 13/14 285/331
5,979,505 A * 11/1999 Drechsel ..... E03F 5/08 138/32

(Continued)

*Primary Examiner* — Steven B McAllister
*Assistant Examiner* — Jonathan Cotov
(74) *Attorney, Agent, or Firm* — Jason T. Daniel, Esq.; Daniel Law Offices, P.A.

(57) ABSTRACT

A vent sealing device includes first and second elongated tubular members having a funnel shaped cap along the upper surface for directing rain water into a vent pipe. A screen is positioned along the top of the device. A vent sealing system includes the vent sealing device and a roof attachment having an elongated base structure and a flexible sleeve protruding outward therefrom.

20 Claims, 8 Drawing Sheets

(56) References Cited

U.S. PATENT DOCUMENTS

| | | | | |
|---|---|---|---|---|
| 6,244,006 | B1 * | 6/2001 | Shue | E04D 13/147 52/302.1 |
| 6,279,272 | B1 * | 8/2001 | Nill, Jr. | E04D 13/1471 285/43 |
| 6,959,457 | B2 * | 11/2005 | Hernandez | E03C 1/122 4/218 |
| 7,775,005 | B2 * | 8/2010 | Johnston | E04D 13/1407 285/44 |
| 8,479,455 | B2 * | 7/2013 | Schaefer | E04D 13/1476 174/564 |
| 8,490,351 | B1 * | 7/2013 | Scott | E04D 13/1476 285/42 |
| 8,574,045 | B2 * | 11/2013 | Warner | E03B 11/08 138/32 |
| 2003/0024185 | A1 * | 2/2003 | Menzies | E04D 13/14 52/219 |
| 2006/0057950 | A1 * | 3/2006 | Heise | E03C 1/122 454/4 |
| 2006/0211356 | A1 * | 9/2006 | Grassman | F23J 13/08 454/4 |
| 2007/0101664 | A1 * | 5/2007 | Hoy | E04D 13/1407 52/198 |
| 2011/0302876 | A1 * | 12/2011 | Giffin | F24F 7/02 52/741.4 |

* cited by examiner

VENT SEALING DEVICE AND SYSTEM

CROSS-REFERENCE TO RELATED APPLICATIONS

This application is a continuation of, and claims the benefit to U.S. Application Ser. No. 61/332,550 filed on May 7, 2010, and U.S. application Ser. No. 13/098,702 filed on May 2, 2011, the contents of each of which are fully incorporated herein by reference.

TECHNICAL FIELD

The present invention relates generally to vent protection devices, and more particularly to a vent sealing device and system which can be utilized to protect or replace damaged flashing.

BACKGROUND

Roof structures typically have one or more openings to allow vents and other objects to extend through. For example, plumbing vents are typically required at all drainage points in a building so that air can displace water draining into the sewer system. During new construction of a building, a hole is cut into the roof structure and a vent pipe is then routed through the hole and connected to the building plumbing. In order to maintain a water-tight seal between the vent and the roof, flashing material (often made from lead) is used to surround the vent and mate with the roof. Unfortunately, squirrels and other rodents are often attracted to the lead flashing and tend to damage it with their claws and teeth. Over time, the damaged flashing can leak or otherwise provide a sub-nominal seal between the vent and roof. Moreover, as the top of the vent pipe is designed to be open to the air, it is common for small animals, rodents and insects to freely enter the vent and gain access to the building plumbing and/or the building itself.

Accordingly, a need exists for a vent sealing device and system that is able to cure the above described deficiencies and which can be easily installed on a new or existing roof structure.

SUMMARY OF THE INVENTION

The present invention is directed to a vent sealing device and system for protecting roofing ventilation shafts.

One embodiment of the present invention can include a vent sealing device that includes a first elongated tubular member having a second tubular member disposed therein via a generally funnel shaped cap. The device functioning to direct rainwater into an existing vent without allowing rain water to make contact with the existing flashing. The device can also include a screen that is configured to prevent debris from entering the vent pipe.

Another embodiment of the present invention can include a vent sealing system having the above described device and a roof attachment unit that includes an elongated base structure having an opening that includes a flexible sleeve protruding outward therefrom.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Figure 1A:
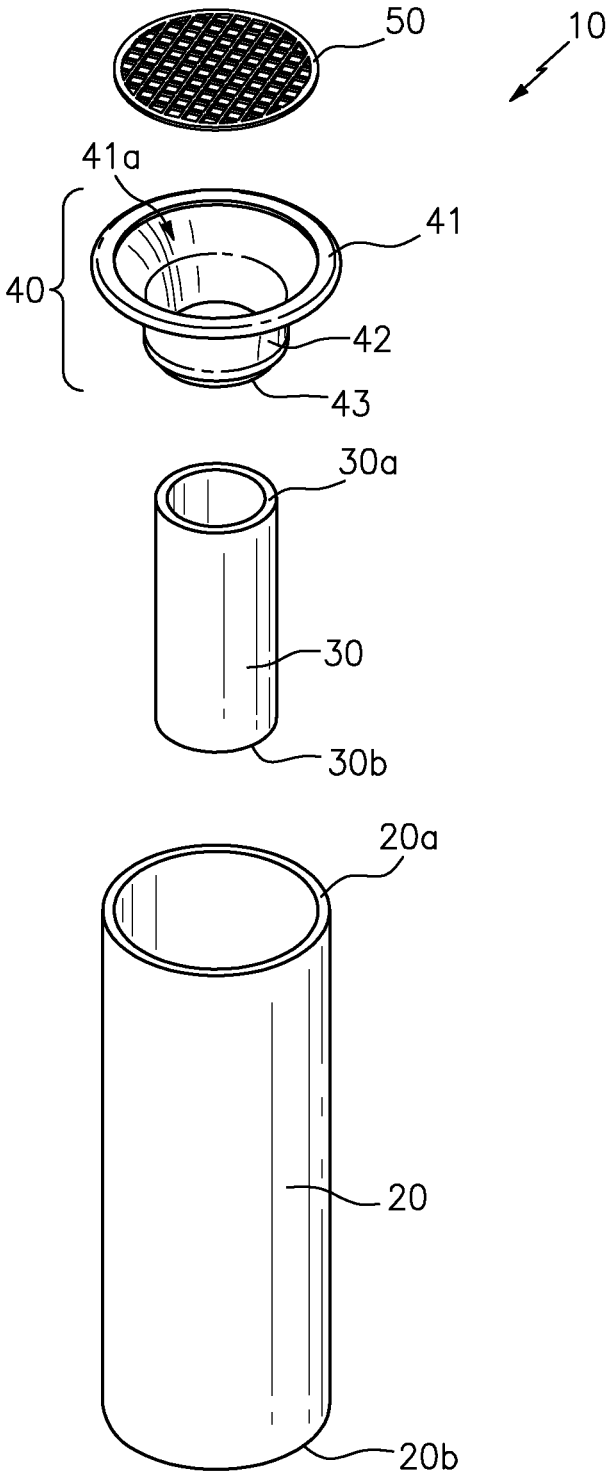
FIG. 1A is an exploded view of a vent sealing device that is useful for understanding the embodiments disclosed herein.
Figure 1B:
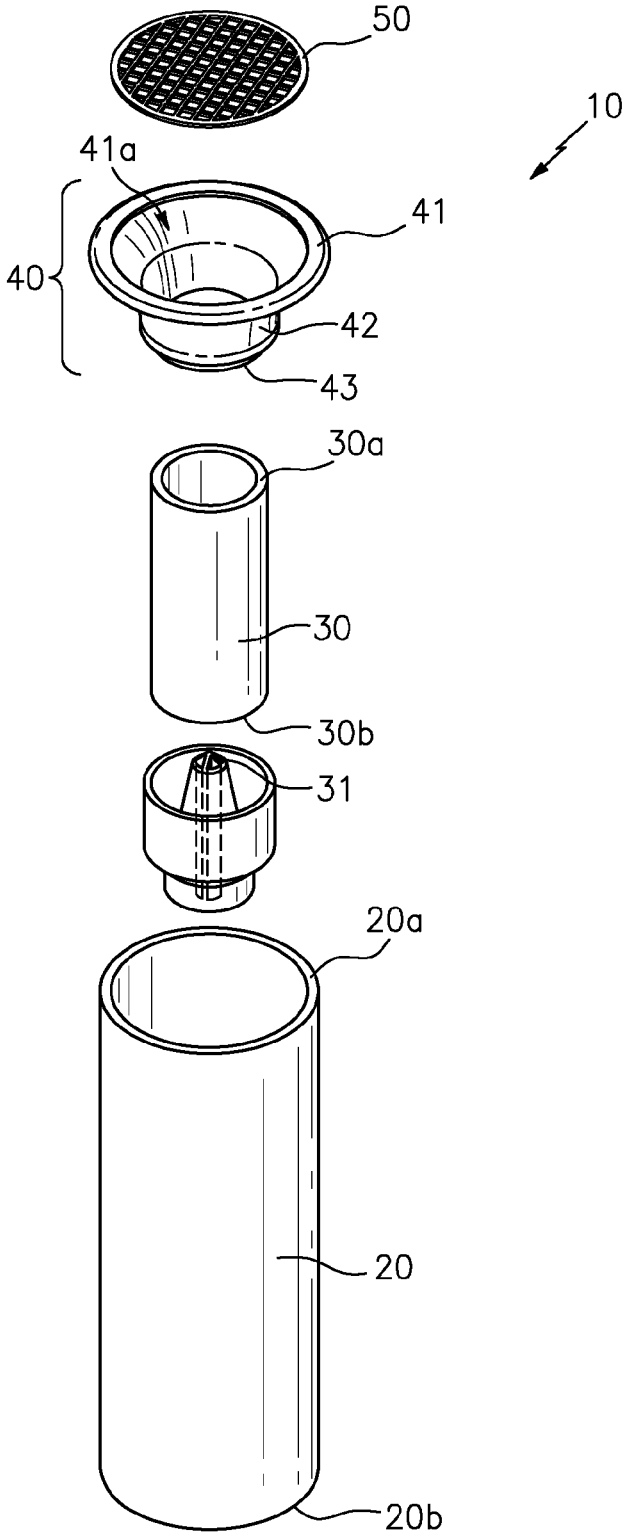
FIG. 1B is an exploded view of a vent sealing device in accordance with one embodiment of the present invention.
Figure 2:
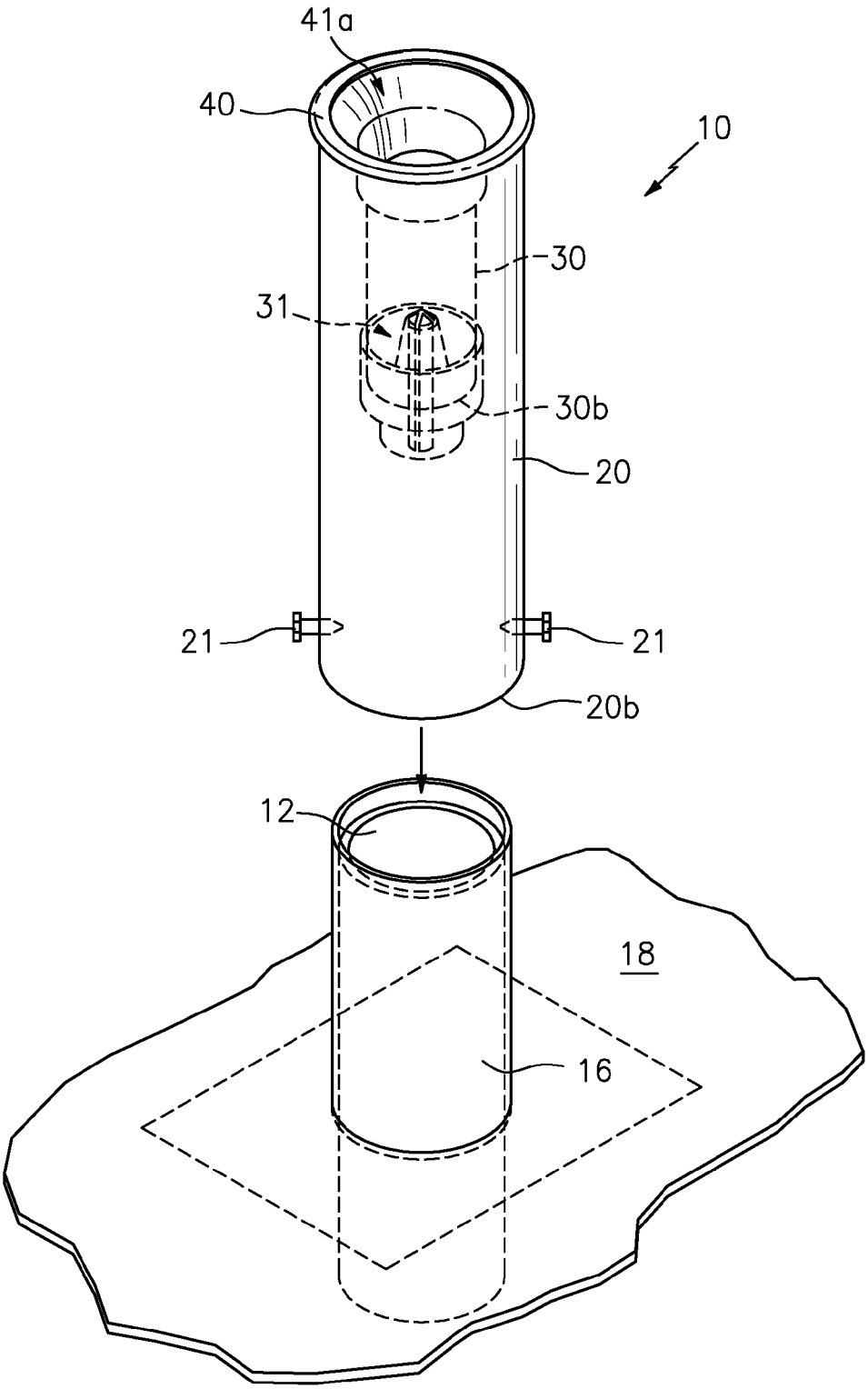
FIG. 2 is a perspective view of the vent sealing device in accordance with one embodiment of the present invention.
Figure 3:
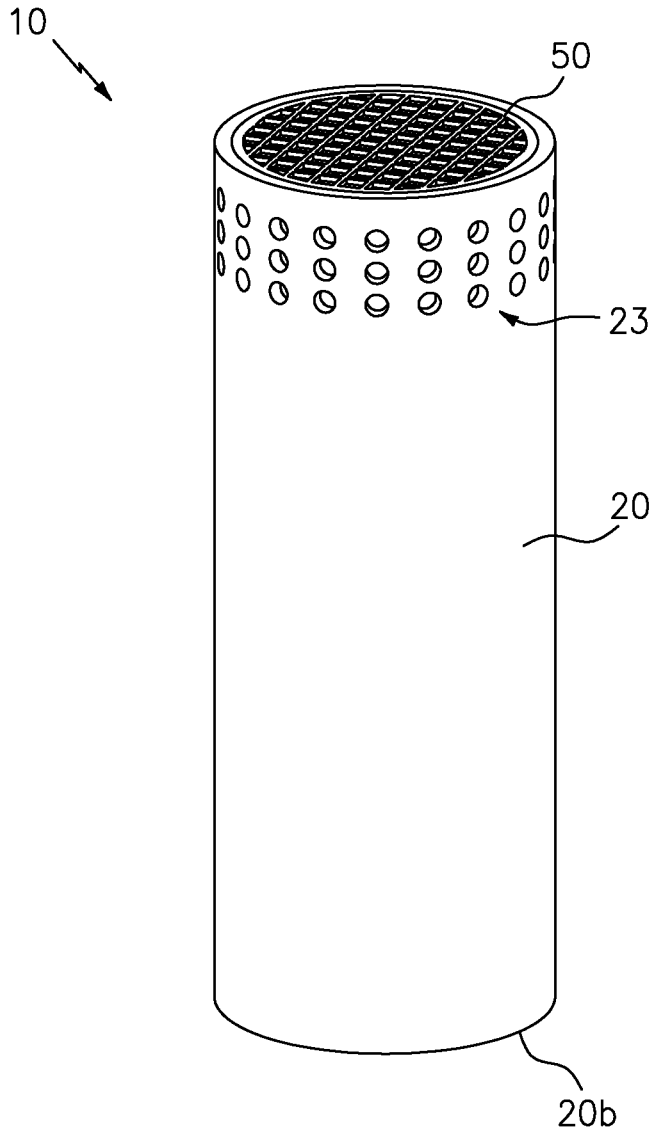
FIG. 3 is a front view of the vent sealing device, in accordance with one embodiment of the present invention.

FIGS. 1-3 illustrate one embodiment of a vent sealing device that is useful for understanding the embodiments disclosed herein. To this end, vent sealing device 10 can include an outer tube 20, an inner tube 30, a cap 40, and a screen 50.

The outer tube 20 (i.e., first tubular member) acts to provide a barrier against exterior elements and can include an elongated hollow tubular section having a top end 20*a*, a bottom end 20*b* and an inner diameter that is greater than both a conventional plumbing vent 12 and conventional flashing 16. (See FIG. 2) Although illustrated as having a bottom portion that is perpendicular to the top, the lower end 20*b* of the outer tube 20 may be disposed at one or more angles to match the existing surface profile of the roof 18. (See FIG. 3)

In one preferred embodiment, outer tube 20 can be constructed from a durable and waterproof material such as polyvinyl chloride pipe (PVC), or acrylonitrile butadiene styrene (ABS) plastic, for example. However, one of skill in the art will recognize that many other materials having similar characteristics can be utilized without diverting from the scope and spirit of the invention.

Outer tube 20 can also include one or more fasteners 21 for securing the vent guard 10 to the flashing/plumbing vent for which it is to cover. In one preferred embodiment, the fasteners 21 can include elongated threated bolts which can be hand or machine tightened against one or more of the conventional plumbing vent 12 and conventional flashing 16. Of course, the device is not limited to this configuration, as the fasteners 21 can include virtually any type of known hardware capable of securing two objects together. Such hardware can include nails, bolts, screws, punch pins and rivets, among many others.

The inner tube 30 (i.e., second tubular member) can include an elongated hollow tubular member having a top end 30*a*, a bottom end 30*b* and an outside diameter that is less than the inside diameter of the outer tube 20 so as to be positionable therein. In one preferred embodiment, inner tube 30 can include a length that is approximately one quarter the length of the outer tube 20 and can also be constructed from PVC or other similar material having good tensile strength. In this regard, the inner tube 30 can be designed to terminate just above the top portion of the vent pipe 12 and can function to direct rainwater directly into the vent pipe without exposing any portion of the existing flashing 16 to the elements (See FIG. 4A).

However, other lengths and materials are also contemplated. For example, in another embodiment, the inner tube 30 can have a length that is greater than the outer tube 20 such that the inner tube extends beyond the bottom of the outer tube. Additionally, the bottom end 30*b* of the inner tube 30 can include an outer diameter that is small enough to be inserted into the plumbing vent 12. To this end, when the inner tube 30 is positioned within the plumbing vent 12, the inner tube can act to provide lateral stability to the vent guard 10, which is useful when being exposed to adverse wind and weather conditions. Moreover, in this capacity, any rain water entering the device 10 can be directed into the vent pipe 12.

Although the inner tube 30 is illustrated above as having a uniform shape and diameter, other embodiments are also contemplated. For example, FIG. 1B illustrates another embodiment of the device 10 wherein the bottom end 30*b* of the inner tube 30 further includes a plurality of vanes 31, each having various lengths, that extend downward therefrom. The vanes 31 acting as a channel for directing small amounts of water that run down the length of the tube 30 towards the center of the device (i.e., central axis), in order to ensure the water flows directly into the existing vent pipe 12, as shown below. Additionally, the diameter of inner tube 30 can taper from a first diameter along the top end 30*a*, to a second diameter along the bottom end 30*b*, said first and second diameters can be any number of different sizes.

In either instance, the cap 40 can function to secure the inner tube 30 within the center of the inside portion of the outer tube 20. In this regard, the cap 40 can function as a funnel which, along with the inner tube 30, operates to direct rain water directly into the inside portion of the plumbing vent 12, while preventing any water from making contact with the outside surface of the existing flashing 16 (which may be damaged and/or leaking).

As shown, the cap 40, can include a generally inverted cone/funnel shaped member having an upper section 41, a graduated frustum-like middle section 42, and a lower section 43. In one preferred embodiment, the three sections 41, 42 and 43 combine to form the cap 40 in one continuous piece while providing an opening/hollow interior channel 41*a* extending from the top section through the bottom section.

In one embodiment, the upper section 41 can include an outside diameter that corresponds to the diameter of the top end of the outer tube 20*a* such that the upper section 41 and the top end 20*a* of the outer tube 20 can be secured together to form a watertight connection. Likewise, the middle section 42 and the lower section 43 can be constructed to fit within the inside portion of the outer tube 20. In this regard, the outside diameter of the lower section 43 can correspond to the diameter of the top end of the inner tube 30*a* such that the lower section 43 and the top end 30*a* of the inner tube 30 can be secured together to form a watertight connection.

In one embodiment, the vent guard 10 can further include a screen or filter 50 which can be permanently or removably affixed to the upper section of the cap 41 and/or the top end of the outer tube 20*a*, in order to extend across the top of the channel 41*a*. In one embodiment, the screen 50 can include a flat sheet of ABS plastic that is glued to the outer periphery of the top end of the cap 41. The screen 50 can include a plurality of small openings suitable for allowing air and water to flow into channel 41*a* while restricting unwanted objects such as leaves, rodents and insects from entering the channel.

Of course any number of other materials such as a conventional screen, for example, and/or attachment materials such as adhesive tape, hook and latch material (i.e. Velcro®) and the like can be provided. In another embodiment, the screen can be formed as an integral component to the cap 40 at a time of construction through the use of known manufacturing processes.

FIG. 3 illustrates another embodiment of the vent guard 10 that further includes one or more breathing/ventilation holes 23 positioned along the outer tube 20. Holes 23 can be used to allow additional venting to the device when needed or desired.

Figure 4:
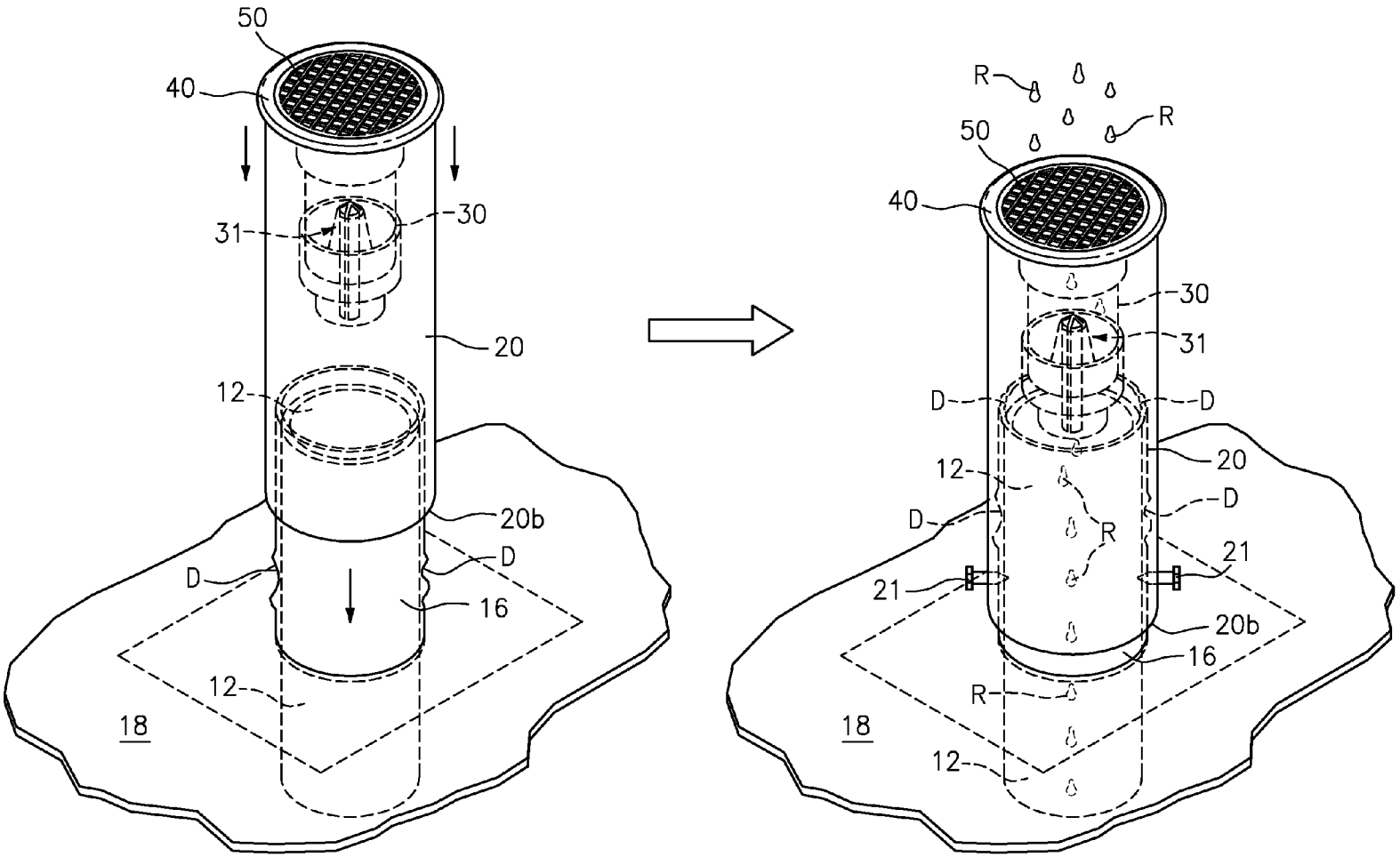
FIG. 4 is a side by side illustration of the a sealing device in operation, in accordance with one embodiment of the present invention.

FIG. 4 illustrates one embodiment of the vent guard 10, described above, in operation. As shown, vent guard 10 can be placed over an existing vent pipe 12 and flashing 16 by inserting the bottom end 20*b* of the outer tube 20 downward along the outside of the flashing 16 until the bottom of the outer tube 20*b* makes contact with the roof 18. When so positioned, the inner tube 30 can be positioned directly above the vent pipe 12 or can extend into the vent pipe 12 depending on the length of the inner tube 30 and the length of the vent pipe 12 protruding through the roof. In either instance, once the bottom of the outer tube 20 makes contact with the roof, the device 10 can be secured to the flashing and vent pipe 12 via the fasteners 21.

When so installed, the outer tube 20 of the device 10 can act to cover any damaged portions D in the existing flashing while simultaneously preventing rodents, insects and the like from making contact with the flashing 16. Moreover, as described above, the cap 40 and inner tube 30 will act as a funnel which will direct any rain water R directly into the vent pipe 12 thereby preventing the outer surface of the flashing 16 (including the damaged portion D) from becoming wet. Such a feature advantageously allows the device to prevent damage to the roof and/or interior of the home which would otherwise be caused by water entering the damaged flashing. Finally, the screen 50 can function to prevent debris and other foreign objects from gaining entry to the building and/or vent pipe. As such, the inventive features disclosed herein can be utilized on existing roof structures without the need to remove conventional flashing which may or may not be damaged.

As described herein, each element of the vent guard 10 can be secured together utilizing any number of known attachment means such as, for example, screws, glue, compression fittings, magnetic elements or other weather-resistant materials. Moreover, although the above embodiments have been described as including separate individual elements, the inventive concepts disclosed herein are not so limiting. To this end, in one preferred embodiment, each element of the vent guard 10 including the outer tube 20, the inner tube 30, the cap 40, and the screen 50, can be formed together as one continuous piece of material, either through manufacturing processes, such as welding, casting, or molding, or through the use of a singular piece of material milled or machined with the aforementioned components forming identifiable sections thereof.

Figure 5:
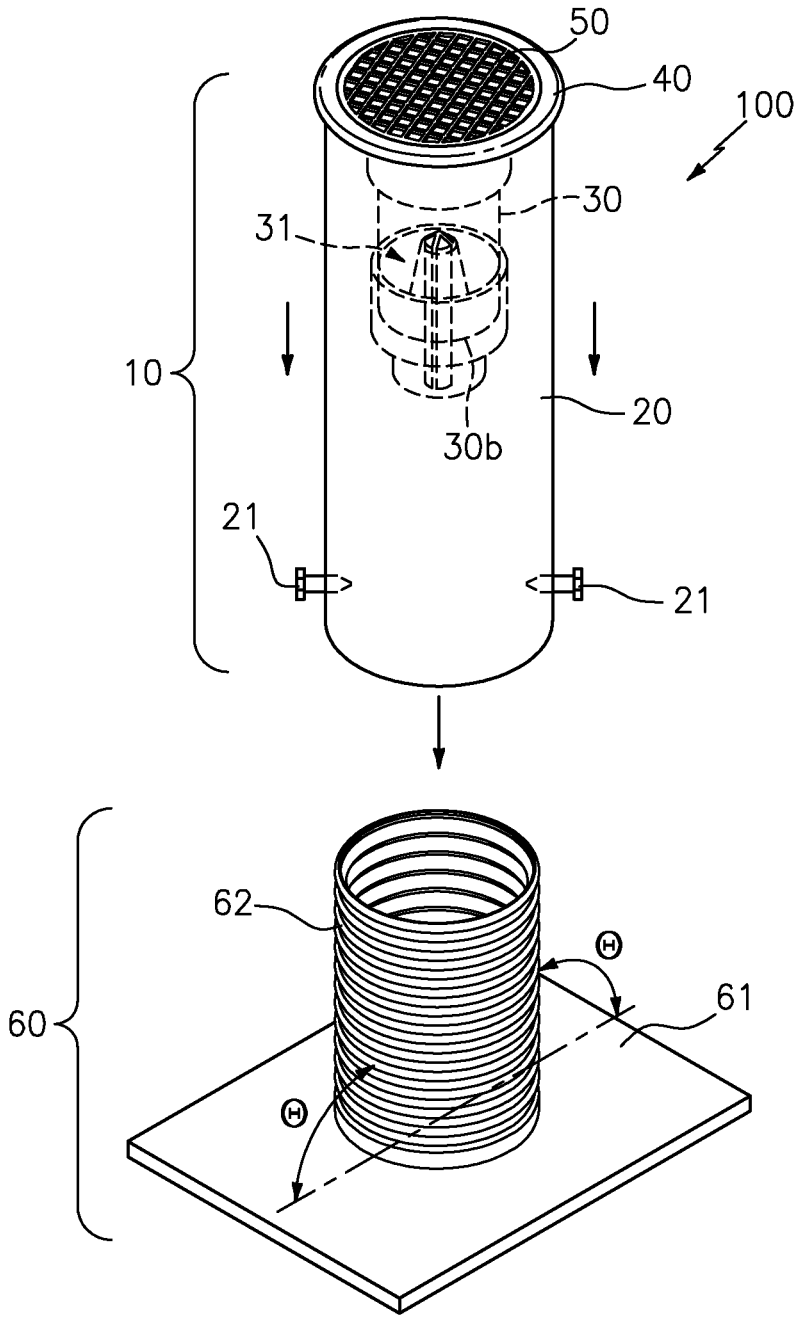
FIG. 5 is a front view of a vent sealing system according to one embodiment of the present invention.
Figure 6:
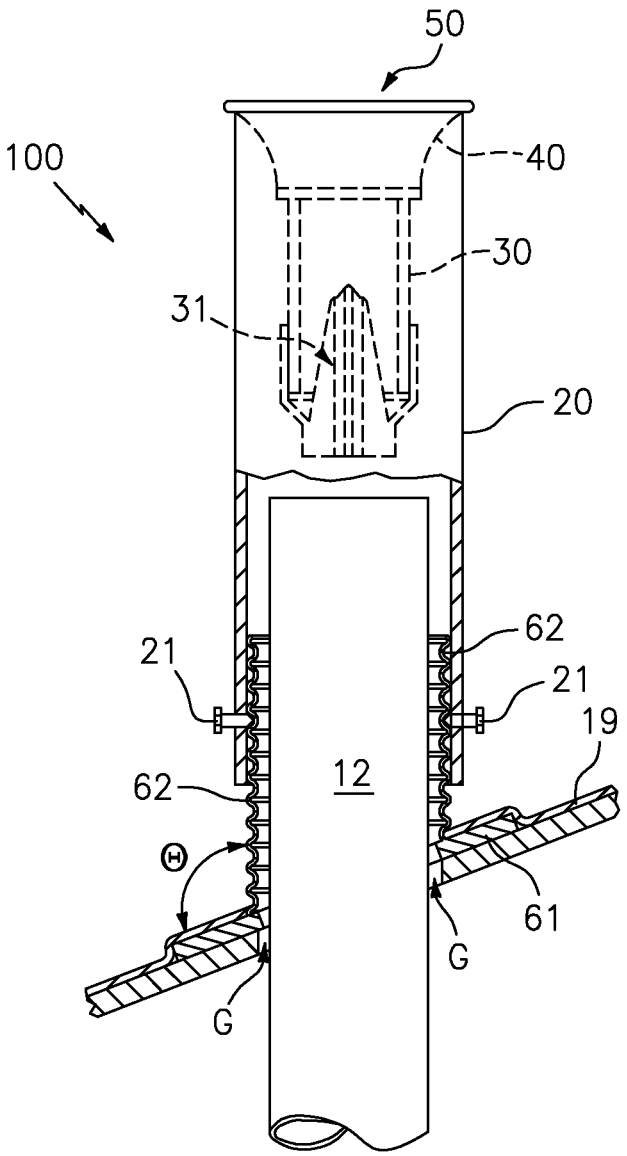
FIG. 6 is a front view of the vent sealing system in operation, in accordance with one embodiment of the present invention.

FIGS. 5 and 6 illustrates one embodiment of a vent sealing system 100 utilizing the vent guard 10 described above and a roof connection unit for allowing the vent guard 10 to be utilized on vent pipes 12 of new construction roofs 18 where no existing flashing has been installed.

The roof connection unit 60 can include a generally flat roof plate 61 configured to rest on top of a building roof 18, and a flexible (corrugated) tubular sleeve 62, each having a central aperture that is configured to be placed over a portion of the vent pipe 12. In one embodiment, the flexible sleeve 62 can be located in the center of the roof plate 61 and can extend outward in a generally perpendicular manner. As described herein, the term "generally perpendicular" is purposefully selected to permit variation of the angles Θ between the roof surface 18 and the vent pipe 12.

As shown in FIG. 6, the system can be installed on a new construction roof (or a roof that is having new shingles installed) as an alternative to conventional flashing. To this end, the flexible sleeve 62 of the connection unit can be positioned over the vent pipe 12 and slid down until the roof plate 61 makes contact with the roof or until a desired position has been achieved. Owing to the flexibility of the sleeve, it is possible for the base plate 61 to be adjusted to rest on the roof surface at virtually any angle Θ.

Once in place, the vent guard can be installed by positioning the vent pipe 12 within the outer tube 20, and sliding the device down until the bottom end of the outer tube 20 makes contact with the base plate 61. In this regard, the outer tube 20 will act to encompass the flexible sleeve 62 as the inner diameter of the outer tube 20 is greater than the outer diameter of the flexible sleeve 62, thus allowing the flexible sleeve 62 to be positioned within the outer tube 20.

Once positioned, the vent guard 10 can be secured to the connection unit 60 via the fasteners 21 or by any number of additional means for securing two items together. In this regard, the system can utilize known components ranging from a leaf spring (not illustrated) interposed between the sleeve 62 and the outer tube 20, or can include threads for allowing the outer tube 20 to be "screwed" onto the flexible sleeve. These are but a few of the numerous possibilities for securing these items together which are contemplated by the inventive concepts disclosed herein.

As shown, the roof plate 61 can be secured in place via a plurality of additional fasteners 21 (such as nails, for example) or can be held in place by the roofing shingles 19. In this regard, any gap G between the vent pipe 12 and the roof surface 18 will be covered by the connection unit 60 without the need for conventional flashing and the vent guard 10 will act to direct rain water into the vent pipe 12, while also protecting against adverse elements and other unwanted pests as described above.

Figure 7:
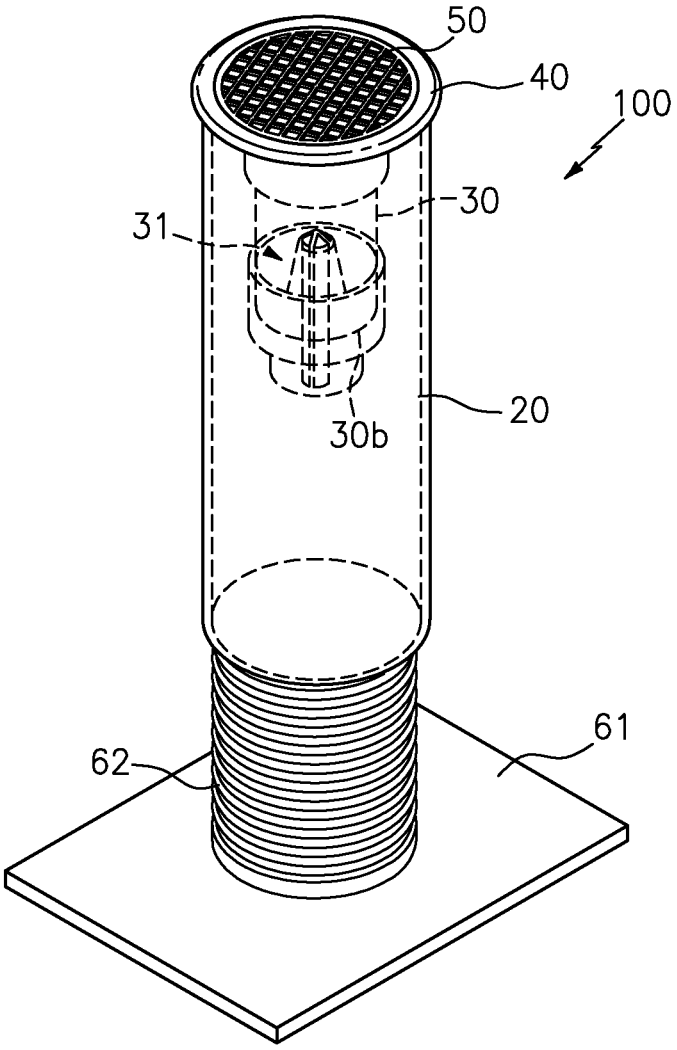
FIG. 7 is a front view of a vent sealing system in accordance with another embodiment of the present invention.

FIG. 7 illustrates another embodiment of a vent sealing system 100 in which the outer tube 20 further includes a flexible tube 62 which is connected to a flat plate 61 as described above. In this regard, both the outer tube 20 and the flexible tube 62 can be fused into a single tubular member acting to perform the dual functions of both the outer tube 20 and the sleeve 62. To this end, resulting system can be installed in virtually the same manner as that described above in a single step.

As the above description explains, the vent sealing device and system can act to protect damaged and new flashing and vent pipes. To this end, in one embodiment, the device will fit snugly over the existing components. For example, in an instance where the vent pipe (12) itself has a two inch opening, the vent sealing system can include the following dimensions: Inner tube 30 inside diameter is 1.8 inches and inner tube outside diameter is 1.9 inches; the base plate can be 2.5 inches; the outer shell inside diameter can be 2.9 inches and the outer shell outside diameter can be 3.1 inches. As would be known to one of skill in the art, the above dimensions are for illustration purposes only, as many other sizes are also contemplated.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A vent sealing device for protecting a vent pipe and flashing extending from a building, said vent sealing device comprising:

a first hollow tubular member having a top end, a bottom end, and an inside diameter that is greater than an outside diameter of each of the vent pipe and the flashing;

a second hollow tubular member having a top end, a bottom end, and an outside diameter that is less than an inside diameter of each of the vent pipe and flashing;

a cap that functions to secure the second tubular member within the first tubular member, said cap including an upper section that is in communication with the top end of the first hollow tubular member, a lower section that is in communication with the top end of the second hollow tubular member, and a graduated middle section that is disposed between the upper and lower sections, said cap further including an opening that is positioned along a central portion of the cap that functions to direct rainwater into the second tubular member; and a screen positioned along the opening of the cap, said screen being configured to prevent debris from entering the second tubular member, wherein the first hollow tubular member functions to cover an exposed portion of both the vent pipe and the flashing, and each of the cap and the second hollow tubular member function to prevent rainwater from making contact with the flashing.

2. The vent sealing device of claim 1, wherein the second tubular member is secured along a central axis of both the first tubular member and the vent pipe.

3. The vent sealing device of claim 1, wherein the bottom end of the first tubular member includes an angle approximating a pitch angle of the roof.

4. The vent sealing device of claim 1, further comprising:

a plurality of vanes that are disposed along the bottom end of the second tubular member, each of said vanes being in communication with an inside portion of the second tubular member and being configured to direct small amounts of rain water into the vent pipe.

5. The vent sealing device of claim 1, further comprising:

one or more securing units that are configured to connect the outer tubular member to at least one of the flashing and vent the pipe.

6. The vent sealing device of claim 1, wherein the second tubular member includes a length that is less than the first tubular member.

7. The vent sealing device of claim 1, wherein the second tubular member includes a length that is greater than the first tubular member.

8. The vent sealing device of claim 7, wherein the second tubular member is configured to be inserted into each of the vent pipe and the flashing to provide lateral stability thereto.

9. The vent sealing device of claim 1, wherein the second tubular member is configured to be inserted into each of the vent pipe and the flashing.

10. The vent sealing device of claim 1, wherein the cap functions as a funnel for directing rainwater into the second tubular member.

11. The vent sealing device of claim 1, wherein the first tubular member further includes a plurality of ventilation holes configured to increase an air flow to the ventilation pipe.

12. The vent sealing device of claim 1, wherein each of the first hollow tubular member, the second hollow tubular member, the cap and the screen are constructed from a unitary piece of waterproof material.

13. A vent sealing system for protecting a vent pipe extending from a building, said system comprising:

a roof connection unit that includes a generally planar member having an opening positioned along a center portion thereof, said planar member being configured to be placed on a building roof, and said opening being configured to receive the vent pipe, a flexible hollow sleeve configured to cover a portion of the vent pipe, said sleeve having a first end connected to the planar member; and a vent sealing device that includes a first hollow tubular member having a top end, a bottom end, and an inside diameter said inside diameter being greater than an outside diameter of the vent pipe and the flexible sleeve, a second hollow tubular member having a top end, a bottom end, and an outside diameter that is less than an inside diameter of the vent pipe, a cap that functions to secure the second tubular member within the first tubular member, said cap including an upper section that is in communication with the top end of the first hollow tubular member, a lower section that is in communication with the top end of the second hollow tubular member, and a graduated middle section that is disposed between the upper and lower sections, said cap further including an opening that is positioned along a central portion of the cap that functions to direct rainwater into the second tubular member; and a screen positioned along the opening of the cap, said screen being configured to prevent debris from entering the second tubular member, wherein the flexible hollow sleeve and the first hollow tubular member function to cover an outside portion of the vent pipe, and each of the cap and the second hollow tubular member function to prevent rainwater from making contact with the outside portion of the vent pipe.

14. The vent sealing system of claim 13, wherein the second tubular member is secured along a central axis of both the first tubular member and the vent pipe.

15. The vent sealing system of claim 13, further comprising:

a plurality of vanes that are disposed along the bottom end of the second tubular member, each of said vanes being in communication with an inside portion of the second tubular member and being configured to direct small amounts of rain water into the vent pipe.

16. The vent sealing system of claim 13, wherein the second tubular member includes a length that is less than the first tubular member.

17. The vent sealing system of claim 13, wherein the second tubular member includes a length that is greater than the first tubular member, and said second tubular member is configured to be inserted into the vent pipe.

18. The vent sealing system of claim 13, wherein the first tubular member further includes a plurality of ventilation holes configured to increase an air flow to the ventilation pipe.

19. The vent sealing system of claim 13, wherein said roof attachment unit and said vent sealing device are permanently secured together.

20. The vent sealing system of claim 13, wherein said roof attachment unit and said vent sealing device are removably secured together.

* * * * *